US011377812B2

(12) United States Patent
Seacat

(10) Patent No.: US 11,377,812 B2
(45) Date of Patent: Jul. 5, 2022

(54) SYSTEM FOR COUPLING AN IMPLEMENT TO A WORK VEHICLE

(71) Applicant: CNH Industrial America LLC, New Holland, PA (US)

(72) Inventor: Daniel Owen Seacat, Valley Center, KS (US)

(73) Assignee: CNH Industrial America LLC, New, PA (US)

( * ) Notice: Subject to any disclaimer, the term of this patent is extended or adjusted under 35 U.S.C. 154(b) by 0 days.

(21) Appl. No.: 16/804,356

(22) Filed: Feb. 28, 2020

(65) Prior Publication Data

US 2021/0270006 A1 Sep. 2, 2021

(51) Int. Cl.

| | |
|---|---|
| ***E02F 3/36*** | (2006.01) |
| ***E02F 3/76*** | (2006.01) |
| ***E02F 3/96*** | (2006.01) |
| *E02F 3/34* | (2006.01) |

(52) U.S. Cl.

CPC ..... *E02F 3/3627* (2013.01); *E02F 3/7609* (2013.01); *E02F 3/96* (2013.01); *E02F 3/3414* (2013.01)

(58) Field of Classification Search

None

See application file for complete search history.

(56) References Cited

U.S. PATENT DOCUMENTS 3,512,665 A * 5/1970 Westendorf ..... E02F 3/3672 414/723
4,509,768 A * 4/1985 Haug ..... A01B 59/062 414/723
10,072,391 B2 9/2018 Takemura et al.
2018/0238016 A1* 8/2018 Seacat ..... E02F 3/3414
2018/0238019 A1* 8/2018 Waters ..... E02F 3/3618
2018/0305889 A1 10/2018 Schiwal

OTHER PUBLICATIONS

Demboys, "Amazing unloading without ramps", Sep. 13, 2013, https://www.youtube.com/watch?v=f0ujPtwfwaw, 1:07, accessed Dec. 9, 2020 (Year: 2013).*

Stanley "Dirt Monkey" Genadek, "He is the most Insane, Skilled, Skid steer Operator in the World", Feb. 16, 2017, https://www.youtube.com/watch?v=7eDIKp5XZFE, 1:58, accessed Dec. 9, 2020 (Year: 2017).*

* cited by examiner

*Primary Examiner* — Gerald McClain

(74) *Attorney, Agent, or Firm* — Peter Zacharias; Patrick Sheldrake

(57) ABSTRACT

A connection system for coupling a working assembly to a work vehicle includes a frame having a mounting portion at a first longitudinal end of the frame. The mounting portion is configured to directly couple to a frame of the work vehicle. The connection assembly also includes a mounting assembly at a second longitudinal end of the frame of the connection system. Additionally, the connection system includes a receiver assembly movably coupled to the frame of the connection system. The receiver assembly is configured to rotate about a point of rotation positioned along the frame of the connection system. The receiver assembly is configured to couple to a connector assembly on an arm of the work vehicle. A top part of the receiver assembly is substantially longitudinally aligned with the point of rotation while the receiver assembly is in a receiving position.

20 Claims, 7 Drawing Sheets

SYSTEM FOR COUPLING AN IMPLEMENT TO A WORK VEHICLE

BACKGROUND

The present disclosure relates generally to a system for coupling an implement to a work vehicle.

Certain work vehicles (e.g., tractors, harvesters, skid steers, etc.) couple to implements configured to perform work. The implements may include blades, augers, backhoes, trenchers, buckets, rakes, brooms, grapples, or other suitable pieces of equipment. The implements may couple to the work vehicle to form one or more connections. To couple the implement to the work vehicle, an operator of the work vehicle may move the work vehicle and/or an arm of the work vehicle in a precise manner to align locking feature(s) on the implement with corresponding locking feature(s) of the work vehicle. It is not uncommon for the operator to move the work vehicle and/or the arm multiple times before the implement and work vehicle are properly aligned for coupling. Additionally, implements that are not directly coupled to a frame of the work vehicle may only be supported by an arm of the work vehicle, leading to a decreased capacity for performing work.

BRIEF DESCRIPTION

In certain embodiments, a connection system for coupling a working assembly to a work vehicle includes a frame that has a mounting portion at a first longitudinal end of the frame of the connection system. The mounting portion is configured to directly couple to a frame of the work vehicle. The connection system also includes a mounting assembly at a second longitudinal end of the frame of the connection system. Additionally, the connection system includes a receiver assembly movably coupled to the frame of the connection system. The receiver assembly is configured to rotate about a point of rotation positioned along the frame of the connection system longitudinally between the first longitudinal end and the second longitudinal end. The receiver assembly is configured to couple to a connector assembly on an arm of the work vehicle. A top part of the receiver assembly is configured to receive a top portion of the connector assembly, and the top part of the receiver assembly is substantially longitudinally aligned with the point of rotation while the receiver assembly is in a receiving position.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1A:
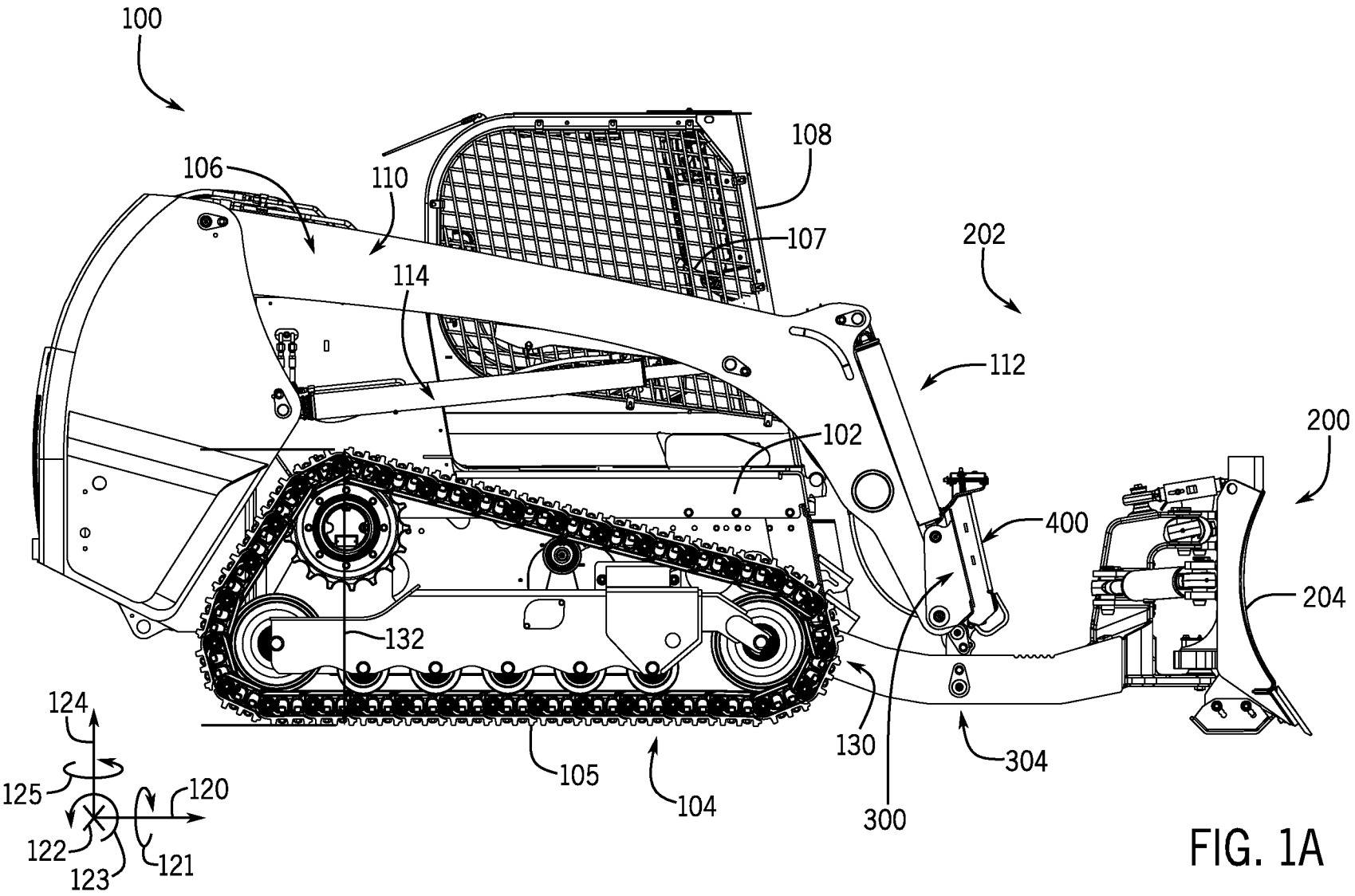
FIG. 1A is a side view of an embodiment of an implement coupled to an embodiment of a work vehicle, in which the implement is in an operating position.

FIG. 1A is a side view of an embodiment of an implement 200 coupled to an embodiment of work vehicle 100, in which the implement is in an operating position 202. The work vehicle 100 has a frame 102 that is supported and moved by a drive system 104 that includes a rolling assembly 105. Alternately, a plurality of wheels or other appropriate rolling system configured to move the work vehicle 100 may be used. In certain embodiments, the work vehicle includes a parking brake that may stop the drive system from moving the work vehicle 100. An arm assembly 106 includes an arrangement of structural members and actuators controllable by an operator, such as by operator controls 107 (e.g., hand controller(s) or lever(s)), to manipulate an implement 200. As further shown in FIG. 1A, the operator controls 107 for controlling the work vehicle 100 may be located within a cab. The frame 102 structurally supports the cab, which at least partially surrounds the operator. A door may provide operator ingress/egress to the cab, and window(s) or opening 108 may enable an operator to view a work environment exterior of the work vehicle, including the implement 200.

It is to be understood that the term "arm assembly" as generally used here not only refers to the input device or devices (e.g., one or more hand controllers, levers, etc.), but also includes various components, such as pumps, hoses, valving, fittings, hydraulic cylinders, hardware, and so forth to control the implement 200, such as a working assembly 204 of the implement 200 (e.g., bucket, blade), in a desired and controlled manner. The arm assembly 106 may move the implement 200 both when the work vehicle 100 is stopped and when the work vehicle 100 is moving. In the illustrated embodiment, the arm assembly 106 includes arms 110 that extend in front of the work vehicle 100 and couple to the implement 200. In certain embodiments, the arm assembly 106 includes one arm 110 on each lateral side of the work vehicle 100. Each arm 110 includes a tilt actuator 112 configured to manipulate (e.g., rotate, twist, move) a connector assembly 300 of the arm relative to the work vehicle 100. The arm 110 further includes a lift actuator 114 configured to extend or contract to manipulate the arm 110 relative to the work vehicle 100. In other embodiments, the arm assembly 106 may include one actuator, two actuators, three actuators, four actuators, five actuators, or any other quantity of actuators suitable for manipulating the arm 110 and/or the implement 200.

Additionally, the implement 200 may be one of many types of implements. In certain embodiments, the implement 200 may be an asphalt miller, a bale spear, a barrier lift, a bucket, a backhoe, a cold planer, a concrete claw, demolition equipment, a dozer blade, a grapple bucket, a Harley rake, a hydraulic brush cutter, a forestry mulcher, a pallet fork, a post driver, a rock saw, a root grapple, a rotary broom, a stump grinder, a tiller, a tree shear, a trench digger, or a vibratory roller, among others.

FIG. 1A further shows multiple axes and movements associated with the axes. These axes and movements are provided to correspond to associated movements of the implement 200 and/or the work vehicle 100. For example, as shown, a longitudinal axis 120 corresponds to a direction of movement of the work vehicle 100 in a longitudinal or "straight-ahead" direction. A rotational movement 121 of the implement 200 or the work vehicle 100 is shown about the longitudinal axis 120, sometimes referred to as "tilt" or roll. FIG. 1A also shows a lateral axis 122 that corresponds to a lateral or side direction with respect to the work vehicle. For example, the lateral axis 122 may align with left and right hand directions of movement. A rotational movement 123 of the implement 200 or the work vehicle 100 about axis 122 is sometimes referred to as a "back-angle" or pitch. A vertical axis 124 extends in a substantially vertical direction with respect to the vehicle. A rotational movement 125 of the implement 200 or the work vehicle 100 about axis 124 is sometimes referred to as "angle" or yaw.

In the illustrated embodiment, the implement 200 is configured to couple to the work vehicle 100 to form two connections between the implement and the work vehicle. In certain embodiments, the implement 200 may be configured to form only one connection. A receiver assembly 400 of the implement 200 is coupled to the connector assembly 300 of the arm 110 to form a first connection 304, and the implement 200 is coupled to the frame 102 to form a second connection 130. As shown, coupling the implement 200 to the frame 102 to form a second connection 130 enables the work vehicle 100 to apply a larger force to the implement 200 and/or perform a greater amount of work with the implement 200, as compared to an implement coupled to the work vehicle to form only the first connection 304 at the arm 110. While the present embodiments include an implement 200 configured to connect to an underside of the frame 102, it is to be understood that the implement 200 may instead be configured to couple to a front surface of the frame 102 and/or side surfaces of the frame 102.

In the illustrated embodiment, a vertical position of the second connection 130 is within the vertical extent 132 (e.g., maximum height, height) of the rolling assembly 105. That is, the implement 200 couples to the frame 102 of the work vehicle 100 at a vertical location that is positioned vertically within the height of the rolling assembly 105. By coupling at this location, the implement 200 is configured to apply force at a location on the work vehicle 100 near or proximate to the ground beneath the work vehicle 100. Accordingly, forces applied to the work vehicle 100 may be efficiently distributed through the work vehicle 100 and/or the rolling assembly 105 of the work vehicle 100. In embodiments in which the vertical position of the second connection 130 is above the vertical extent 132 of the rolling assembly 105, forces applied to the work vehicle 100 via the implement 200 may cause the work vehicle 100 to tip backward in an undesired manner. Further, in embodiments in which the vertical position of second connection 130 is below the vertical extent 132 of the rolling assembly 105, forces applied to the work vehicle 100 via the implement 200 may cause the work vehicle 100 to tip forward in an undesired manner. Accordingly, it is desirable to couple the implement 200 to the work vehicle at a vertical location that is within the vertical extent 132 of the rolling assembly 105.

Systems and methods are described herein that enable the operator to initiate a coupling process for coupling the implement 200 to the work vehicle 100. The coupling process may be used to couple the work vehicle 100 to implements 200 to form either one or more connections. In embodiments including two connections, the first connection 304 (e.g., the connection between the connector assembly 300 and the receiver assembly 400) may be substantially similar. That is, implements coupled to work vehicles only by the first connection may be configured to receive the same connector assembly 300 as implements 200 configured to form two connections 304, 130. Accordingly, the method and systems described herein are compatible with implements configured to form only the first connection 304. In certain embodiments, the operator may provide an input to the work vehicle 100 to indicate the number of connections the implement is configured to form. The work vehicle 100 may accordingly operate in a "heavy-duty mode" configured to perform more work and/or apply larger forces when the implement is coupled to the work vehicle to form two connections. In addition, the work vehicle 100 may operate in a "light-duty mode" when the implement is only coupled to the work vehicle to form one connection. The coupling process and the connections established by the process may be better understood with reference to FIG. 1B, depicting the work vehicle 100 when not coupled to an implement 200, and FIG. 1C, depicting the implement when not coupled to a work vehicle 100.

As shown in the present embodiments, one implement 200 is connected to form the two connections 304, 130 to the work vehicle 100. However, in certain embodiments, two implements may be connected to the work vehicle, for example, by connecting a first implement to of the connector assembly 300 and by connecting a second implement to the frame 102 of the work vehicle. In certain embodiments, the first implement is controlled by manipulating the arm 110 of the work vehicle and the second implement is controlled by movement of the work vehicle and/or by additional actuators disposed on the work vehicle suitable for manipulating the second implement. By connecting two implements to one work vehicle, work that is more specific may be performed with the work vehicle.

Figure 1B:
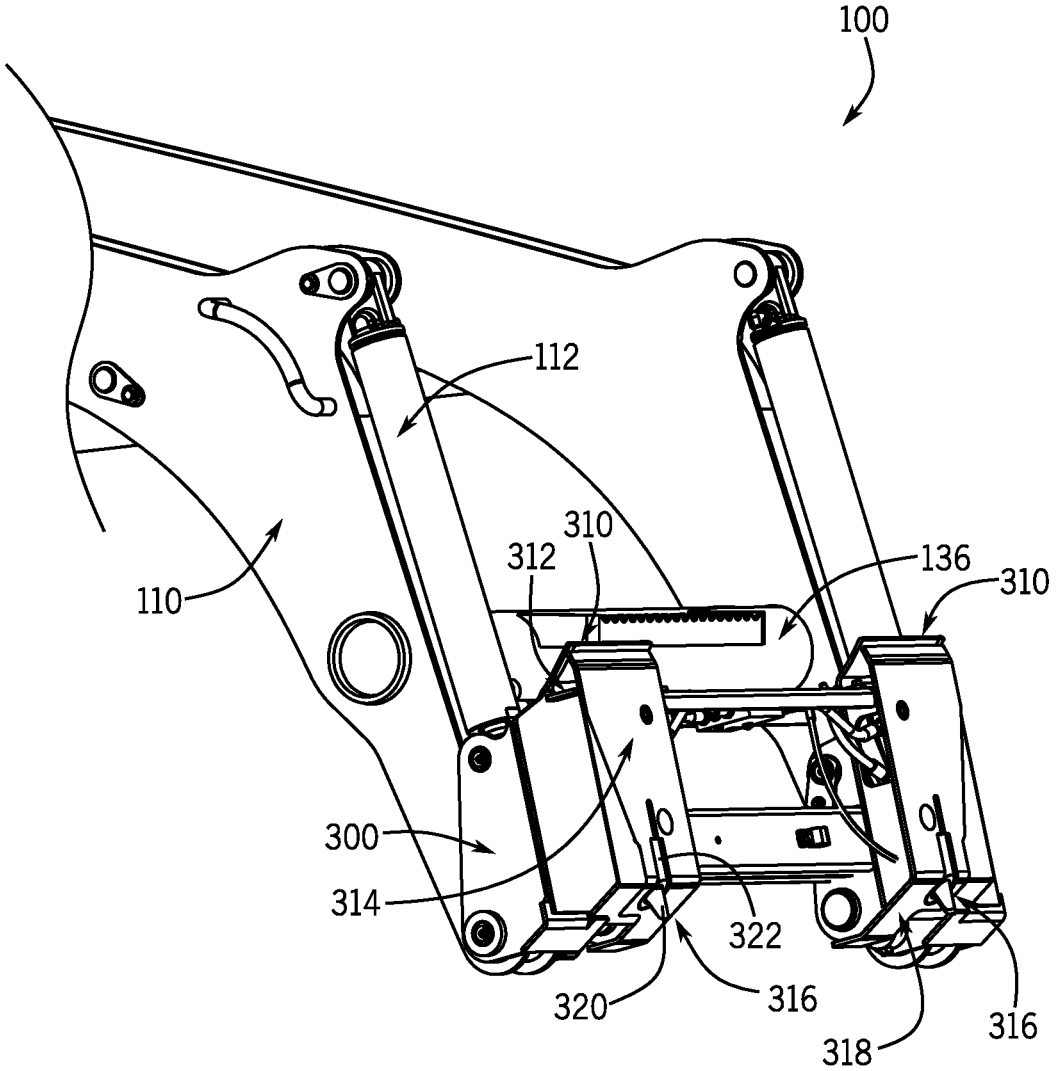
FIG. 1B is a perspective view of an embodiment of a connector assembly that may be employed within the work vehicle of FIG. 1A.
Figure 1B:
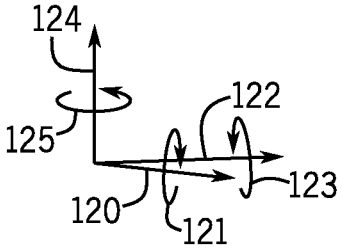
Figure 1C:
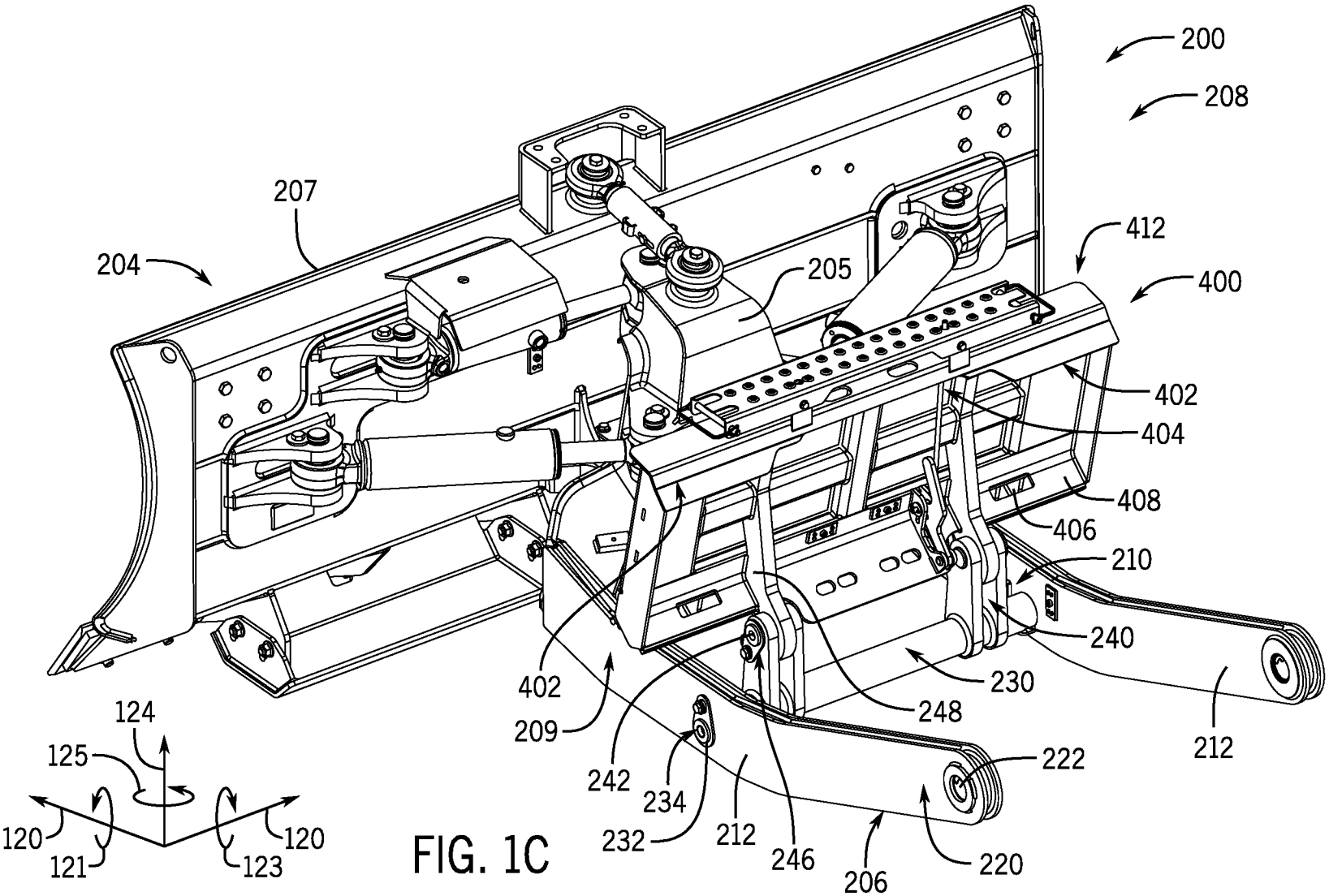
FIG. 1C is a perspective view of the implement of FIG. 1A.

FIG. 1B is a perspective view of an embodiment of the connector assembly 300 that may be employed within the work vehicle of FIG. 1A. As illustrated, the connector assembly 300 of the arm 110 is not coupled to the receiver assembly of the implement. In certain embodiments, the connector assembly 300 is configured to couple to the receiver assembly of the implement to from the first connection. In certain embodiments, the tilt actuator 112 may be controlled to extend or contract by the operator. The tilt actuator 112 tilts the connector assembly 300 in pitch 123 relative to the arm 110. The work vehicle 100 includes multiple features to move the arm 110 and the connector assembly 300, and the connector assembly 300 include multiple features that interface with the receiver assembly, as described herein.

In certain embodiments, the arm assembly 106 includes a support beam 136 coupled each arm 110. The support beam 136 structurally supports the arms 110 to enable the work vehicle 100 to support a higher load and/or perform a greater amount of work, as compared to an arm assembly without a support beam. It is to be understood that any suitable number of support beams of any suitable shape may be coupled to each arm 110, or the support beam 136 may be omitted.

In the illustrated embodiments, the connector assembly 300 includes two protrusions 310 disposed on a top portion 312 of the connector assembly 300. In certain embodiments, the protrusions 310 (e.g., stationary protrusions) extend longitudinally in the direction 122 and vertically upward in the direction 124. As shown, the connector assembly 300 includes two protrusions 310, each of which is generally shaped as triangular prisms that extend longitudinally along the direction 122 and vertically along the direction 124. It is to be understood that in other embodiments, the protrusions 310 may have a different shape, such as rectangular prisms, trapezoidal prisms, cylinders, posts, or other shapes suitable for coupling to an implement. Additionally, there may be a different quantity of protrusions such as one, two, three, four, five, six, or any quantity of protrusions suitable for facilitating the coupling process. Further, the protrusions 310 may be disposed on a different portion of the connector assembly, such as an outer portion 314 of the connector assembly, so long as the protrusion is suitable for coupling to an implement.

In certain embodiments, the connector assembly 300 includes locking features 316 for coupling the connector assembly 300 to the receiver assembly of the implement. In the current embodiment, the connector assembly 300 includes two locking features 316 that protrude from a bottom portion 318 of the connector assembly 300. However, in other embodiments, there may be a different quantity of locking features, such as one, two, three, four, five, six, or any quantity of locking features suitable for coupling the connector assembly 300 to the implement. In some embodiments, the locking features 316 are moveable pins that move between positions when manipulated by locking actuators of the connector assembly. In certain embodiments, the locking actuators receive a working fluid (e.g., hydraulic fluid) from a valve assembly that is controlled by the operator, and the locking actuators move the locking features 316 into the target positon.

The locking actuators are configured to transition the locking features 316 between a first position and a second position. In the first position, an extension 320 of each locking feature 316 is fully retracted into a respective receptacle. In certain embodiments, the extensions 320 of the locking features 316 have a tapered edge. In certain embodiments, the extensions 320 may be conical such that a cross section of each extension 320 is arcuate. Alternatively, each extension 320 may taper more prominently along one side of the extensions 320 such that any cross section through the extension 320 has at least one flat side (e.g., semicircular). However, the extensions 320 may be any suitable shape (e.g., cylinders, rectangular prisms, triangular prisms, etc.) with any corresponding cross sections (e.g., circles, rectangles, triangles) for coupling the connector assembly 300 to the receiver assembly. In certain embodiments, the receptacles 322 are hollow cylinders that each have a bottom portion aligned in the same plane as a bottom portion 318 of the connector assembly 300. Accordingly, in embodiments in which the locking features 316 are in the first position, the bottom portion 318 of the connector assembly 300 is approximately smooth or planar (i.e., has no protrusions, projections, bumps etc.).

As shown in FIG. 1B, the locking features 316 are in the second position. In the second position, the extensions 320 are extended from the receptacles 322. Accordingly, while the locking features 316 are in the second position, the extensions 320 protrude from both the receptacles 322 and the bottom portion 318 of the connector assembly 300.

FIG. 1C is a perspective view of the implement 200 of FIG. 1A. As illustrated, the implement 200 is not coupled to the work vehicle. The implement 200 includes the working assembly 204, which may be configured to perform work (e.g., plow, dig, plant, etc.). In the illustrated embodiment, the working assembly 204 includes a mounting assembly 205 that couples a blade 207 of the implement to a frame 206 of the implement. In the illustrated embodiment, the mounting assembly 205 of the implement 200 is rigidly coupled (e.g., welded, bolted, non-rotatably coupled, etc.) to a distal portion/end 209 (e.g. second end or second longitudinal end) of the frame 206 of the implement 200 and rotatably coupled to the working assembly 204 of the implement 200. In the illustrated embodiment, the implement 200 also includes a connection system 208. The connection system 208 includes the receiver assembly 400, the frame 206 of the implement 200, and a pivot assembly 210 of the implement 200.

In the illustrated embodiment, the frame 206 is a C-frame and may be formed of a structurally strong material (e.g., steel) to support the weight of the working assembly 204 and transfer horizontal forces (e.g. loads) through the frame 206 of the implement 200. In the illustrated embodiment, the frame 206 includes two arms 212 (e.g. extensions). In further embodiments, the frame of the implement may include more or fewer arms. The frame 206 additionally includes a mounting portion 220 at an end (e.g., first end or first longitudinal end) of the frame 206 opposite of the distal portion 209. In the illustrated embodiment, the mounting portion 220 includes mounting features 222. In the illustrated embodiment, the mounting features 222 are openings disposed through the mounting portion 220 of the frame. However, the mounting features 222 may be other suitable mounting and/or locking features in further embodiments, such as hooks or pins, among others.

As shown in FIG. 1C, the pivot assembly 210 is disposed between the frame 206 and the receiver assembly 400 (e.g., between the distal portion 209 and the mounting portion 220 of the frame 206). In the illustrated embodiment, the pivot assembly 210 of the connection system 208 includes a pivot tube 230 disposed between the arms 212 of the frame 206. The pivot tube 230 is rotatably connected to arms 212. In the illustrated embodiment, the rotatable connection is provided by tube pins 232 of the pivot assembly 210. The tube pins 232 are disposed through respective openings of the arms 212, such that the pivot tube 230 is rotatably connected between the tube pins 232. In certain embodiments, a bushing is disposed circumferentially around each tube pin 232 to provide the rotatable connection between the arms 212 and the pivot tube 230. In this manner, the pivot tube 230 may provide a first point of rotation 234 between the receiver assembly 400 and the frame 206. Further, in certain embodiments, a single tube pin may be disposed through both arms of the frame, instead of one tube pin 232 disposed through each arm 212.

Additionally, in the illustrated embodiment, the pivot assembly 210 includes links 240 rigidly coupled (e.g., welded) to the pivot tube 230. The links 240 are rotatably connected to the receiver assembly 400 of the implement 200 via link pins 242. In this manner, the links 240 provide a second point of rotation 246 between the receiver assembly 400 and the frame 206 (e.g., between the receiver assembly 400 and the pivot tube 230). In the illustrated embodiment, there are two links 240 disposed on each lateral side of extensions 248 of the receiver assembly 400. However, in other embodiment, there may be a different number of links and/or extensions. In addition, while the links 240 are pivotally coupled to the extensions 248 in the illustrated embodiment, in other embodiments, at least one link may be coupled to another suitable structure of the receiver assembly. Alternatively, in certain embodiments, the links 240 may be omitted, and the receiver assembly 400 may be directly pivotally coupled to the frame 206 of the implement 200 at the first point of rotation 234.

In the illustrated embodiment, the length of each extension 248 along the longitudinal direction 120 is particularly selected such that a top part 412 of the receiver assembly 400 and the first point of rotation 234 are substantially longitudinally aligned (e.g., substantially aligned along the longitudinal axis 120) while the receiver assembly 400 is in the receiving position (e.g., prior to initial contact with the connector assembly 300). In certain embodiments, "substantially longitudinally aligned" refers to an alignment in which the distance along the longitudinal direction 120 between the top part 412 of the receiver assembly 400 and the first point of rotation 234 is within a threshold distance. Additionally, the length of each extension 248 along the longitudinal direction 120 is particularly selected such that when the connector assembly initially engages the receiver assembly (e.g., when the top portion of the connector assembly first contacts the top part 412 of the receive assembly), the top portion of the connector assembly and the first point of rotation 234 are substantially longitudinally aligned (e.g., substantially aligned along the longitudinal axis 120). That is, the longitudinal distance between the top portion of the connector assembly and the first point of rotation 234 is within a threshold distance. For example, the threshold distance (e.g., distance between the top part of the receiver assembly and the first point of rotation, or the distance between the top portion of the connector assembly and the first point of rotation) may be 0.1 centimeters (cm), 0.5 cm, 1 cm, 5 cm, or 10 cm.

In the illustrated embodiment, while the receiver assembly 400 is in the receiving position (e.g., prior to initial contact with the connector assembly), the first point of rotation 234 and the receiver assembly 400 are positioned such that the first point of rotation 234 and the top part 412 of the receiver assembly 400 are substantially longitudinally aligned (e.g., substantially aligned along the longitudinal axis 120). Accordingly, the first point of rotation 234 is positioned proximate to the longitudinal center of gravity of the implement, such that when establishing the first connection with the connector assembly, the tendency of the implement 200 to rotate forwardly about the lateral axis 122 in pitch 123 (e.g., away from the operator) is substantially reduced (e.g., as compared to an implement having a first portion of rotation positioned closer to the mounting features). In certain embodiments, "substantially longitudinally" aligned refers to a difference in position along the longitudinal axis 120 of 0.1 cm to 10 cm, 0.5 cm to 10 cm, 1 cm to 10 cm, 2 cm to 8 cm, 3 cm to 5 cm, or 4 cm to 5 cm. Furthermore, in certain embodiment, "substantially longitudinally aligned" refers to a difference in position along the longitudinal axis 120 of less than 0.1 cm, 0.5 cm, 1 cm, 5 cm, or 10 cm. In addition, in certain embodiments, "substantially longitudinally aligned" refers to a maximum difference in position along the longitudinal axis 120 expressed as a percentage of the longitudinal extent of the frame 206. For example, the maximum percentage of distance between the first point of rotation 234 and the top part 412 of the receiver assembly 400 along the longitudinal axis 120 relative to the longitudinal extent of the frame 206 of the implement 200 may be less than 1 percent, 2 percent, 3 percent, 4 percent, or 5 percent.

The receiver assembly 400 of the implement 200 is configured to couple to the connector assembly of the arm of the work vehicle to establish the first connection. The receiver assembly 400 includes two recesses 402 disposed on an inner portion 404 of the receiver assembly 400. The receiver assembly 400 includes locking features 406 through a lower portion 408 of the receiver assembly 400. In the illustrated embodiment, the locking features 406 are openings configured to receive the corresponding locking elements of the connector assembly of the work vehicle. In certain embodiments, there may be more or fewer recesses 402 to match the corresponding locking features (e.g., protrusions) of the connector assembly. Additionally, there may be more or fewer locking features 406 to match the corresponding locking features on the connector assembly. An embodiment of the recesses 402 and the locking features 406 used to couple the receiver assembly 400 to the connector assembly is described with reference to FIG. 3 below.

Figure 2A:
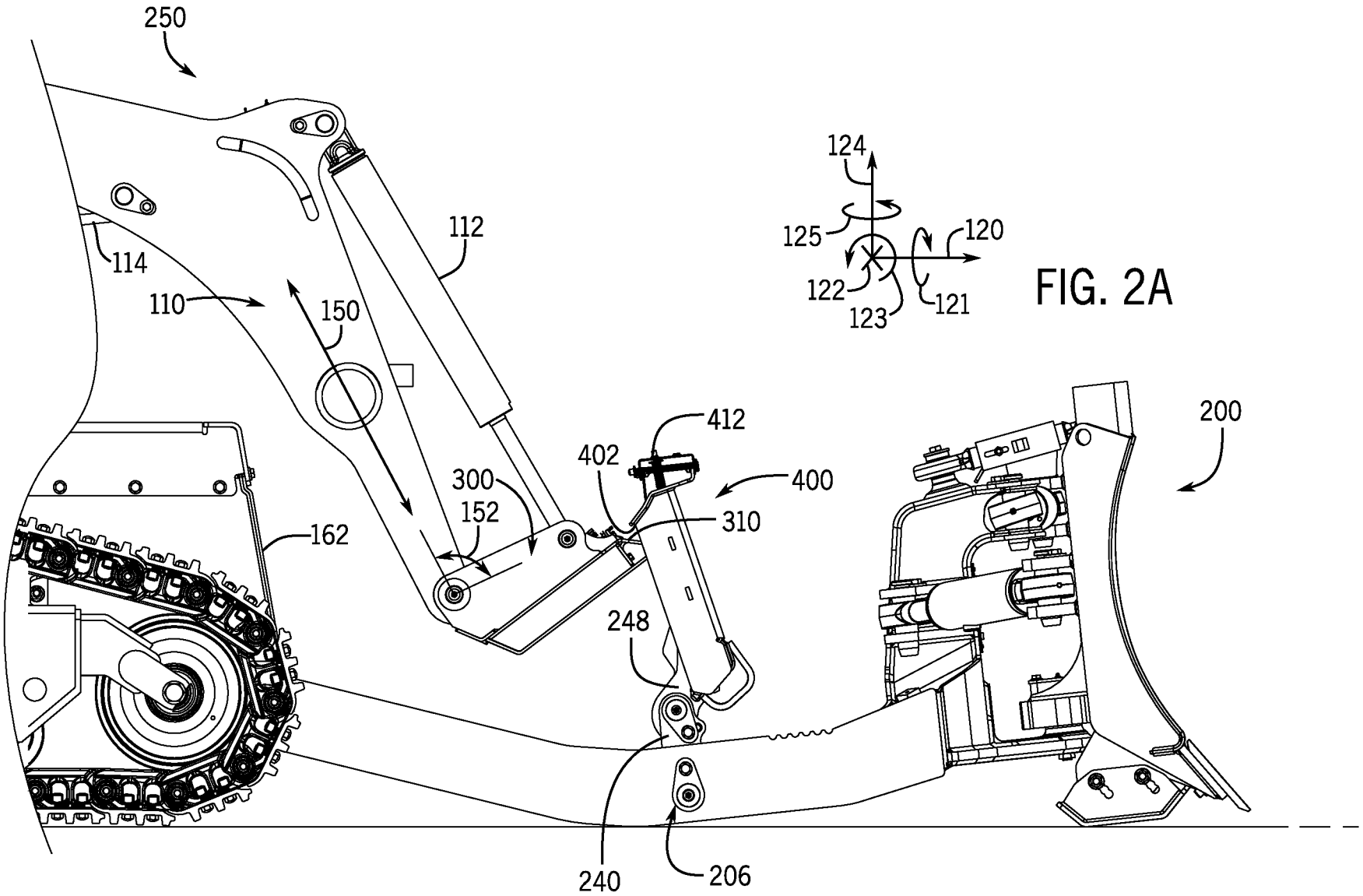
FIG. 2A is a side view of the connector assembly of FIG. 1B adjacent to the implement of FIG. 1A, in which the implement is in a starting position.

FIG. 2A is a side view of the connector assembly 300 of FIG. 1B adjacent to the implement 200 of FIG. 1A, in which the implement 200 is in a starting position 250. In certain embodiments, the starting position corresponds to a position in which the connector assembly 300 is tilted to a target starting angle (e.g., within a threshold angle of the target starting angle). The connector assembly 300 is located a target distance from the receiver assembly of the implement (e.g., within a threshold range of the receiver assembly 400 of the implement 200). In the starting position 250, the tilt actuator 112 may be at least partially extended. As such, the connector assembly 300 is tilted from a longitudinal axis 150 of the arm 110 at a connector angle 152 (e.g., corresponding to the target starting angle). The target starting angle of the connector assembly 300 relative to the longitudinal axis 150 may be about 30 degrees, about 45 degrees, about 75 degrees, or any other suitable angle relative to the axis 150. For example, the target starting angle may be between 100 degrees and 10 degrees, between 75 degrees and 30 degrees, or any other suitable range of angles relative to the axis 150. Additionally, in certain embodiments, the target starting angle and the connector angle 152 may instead be determined relative to the direction/axis 124 or the direction/axis 120.

In certain embodiments, the connector angle 152 is established by the operator. For example, the operator may control the tilt actuator 112 to move to a target connector angle. The operator of the work vehicle 100 visually identifies the connector angle 152 and use the operator controls to adjust the connector angle 152 to the target starting angle or within the threshold range of the target starting angle.

As described above, the starting position 250 may be achieved when the connector assembly 300 is within the threshold distance of the receiver assembly 400. In certain embodiments, the operator may move the work vehicle 100, the arm 110 of the work vehicle, the connector assembly 300, or a combination thereof, until the connector assembly 300 is in the starting position 250 (e.g. within the threshold distance of the starting distance, within the threshold angle of the starting angle, or a combination thereof) before initiating the coupling process. The threshold distance may be about 0 cm, 1 cm, 2 cm, 5 cm, 20 cm, 100 cm, or any other suitable distance for starting the coupling process. In certain embodiments, the threshold distance may be between 0 and 100 cm, between 5 cm and 50 cm, between 10 cm and 20 cm, or any other suitable range for starting the coupling process.

Figure 2B:
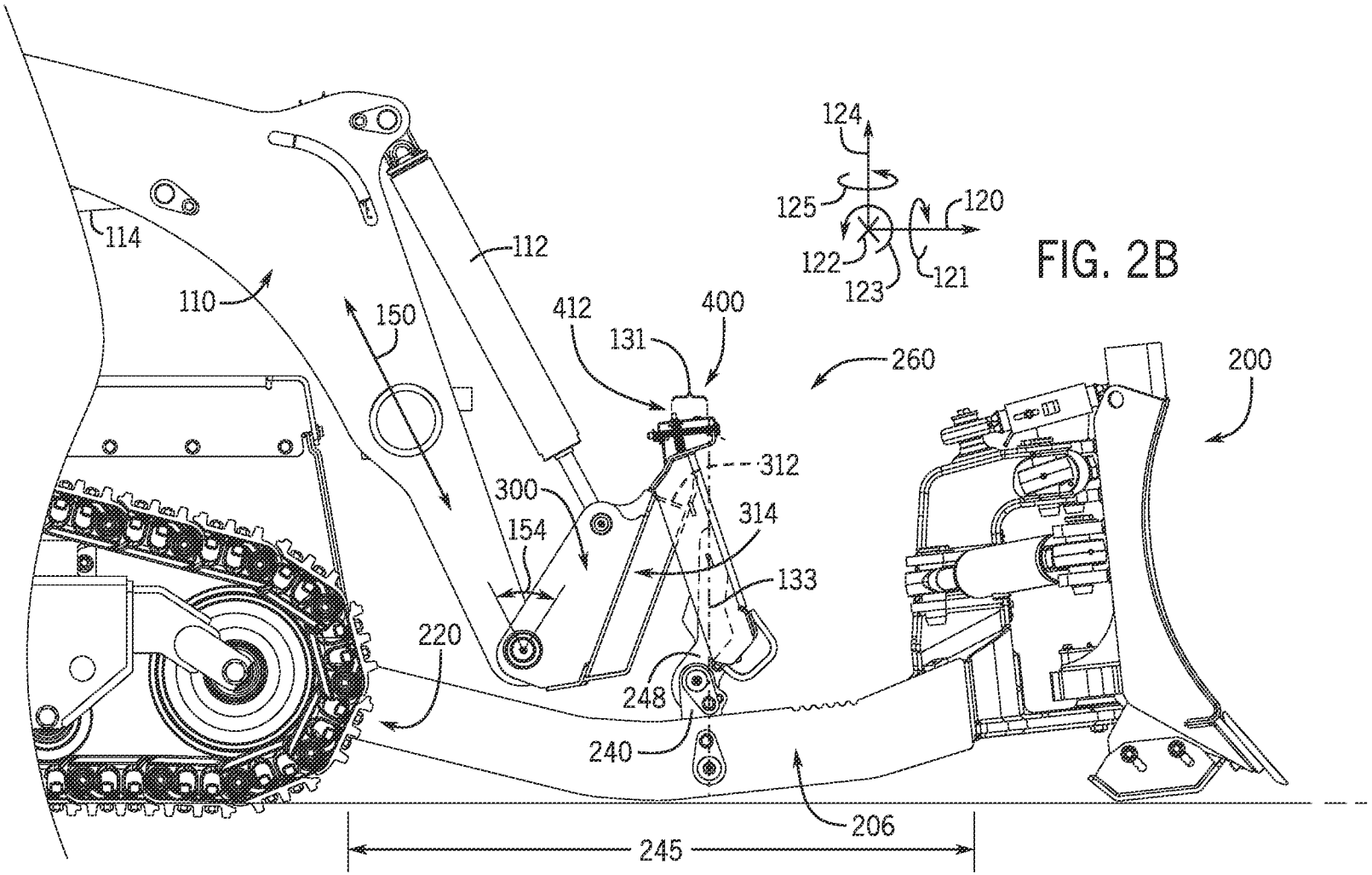
FIG. 2B is a side view of the connector assembly of FIG. 1B partially coupled to the implement of FIG. 1A, in which a receiver assembly of the implement is in a receiving position.

FIG. 2B is a side view of an embodiment of the connector assembly 300 of FIG. 1B partially coupled to the implement 200 of FIG. 1, in which the receiver assembly 400 is in the receiving position. As shown, the connector assembly 300 is rotated to a second connector angle 154 relative to the longitudinal axis 150 of the arm 110. In certain embodiments, the rotation is achieved by contraction of the tilt actuator 112. In certain embodiments, the operator may coordinate movement of the drive system, the tilt actuator 112, the lift actuator 114, or a combination thereof, until the connector assembly 300 is aligned with the receiver assembly 400. For example, the connector assembly 300 may be tilted to the second connector angle 154 as the drive system moves the work vehicle forward, such that the connector assembly 300 rotates backward in pitch 123 and aligns with the receiver assembly 400. In certain embodiments, the connector assembly 300 may align with the receiver assembly 400 by tilting the connector assembly 300 to the second connector angle 154 as the lift actuator lifts the connector assembly 300, such that the protrusions 310 engage the recesses 402 of the receiver assembly 400. Accordingly, in certain embodiments, the connector assembly 300 may be aligned with the receiver assembly 400 by tilting the tilt actuator 112, lifting the arms 110, moving the work vehicle 100 forward, or a combination thereof.

In certain embodiments, the operator controls the movements of the actuators and the drive system from the starting position 250. For example, after the operator identifies the starting position 250, the operator may control the tilt actuator 112 to move to a target tilt actuator position, control the lift actuator to move the mounting portion to a target mounting portion vertical position, control the drive system to move the work vehicle forward a target distance, or a combination thereof. After these movements, the connector assembly 300 may be coupled to the receiver assembly 400, as shown.

Additionally, when the connector assembly 300 is aligned with the receiver assembly 400, the locking elements of the connector assembly 300 are aligned with the locking features of the receiver assembly 400. The operator may then control the actuators to move the extensions to the extended position such that the locking elements protrude into the corresponding locking features of the implement 200. Upon completion of the movement of the work vehicle 100, detection that the connector assembly 300 is aligned with the receiver assembly 400, engagement of the locking elements with the locking features of the implement, the parking brake may engage to block unintentional and/or undesired subsequent movement of the work vehicle.

In certain embodiments, while the receiver assembly 400 is in the illustrated receiving position, the first point of rotation 234 and the top part 412 of the receiver assembly 400 are positioned such that the longitudinal distance (e.g., distance or offset 131 along the longitudinal axis 120 between the first point of rotation 234 and the top part 412 of the receiver assembly 400) is within a threshold distance. To illustrate the offset 131, a point of rotation line 133 is shown extending along the vertical axis 124 through the first point of rotation 234. For example, the threshold distance may be 1 percent, 2 percent, 3 percent, 4 percent, or 5 percent of the longitudinal extent 245 of the frame 206. Additionally, while the connector assembly 300 initially engages the receiver assembly 400 and the receiver assembly 400 is in the illustrated receiving position, the first point of rotation 234 and the top portion 312 of the connector assembly 300 are positioned such that the longitudinal distance (e.g., distance or offset 131 along the longitudinal axis 120 between the first point of rotation 234 and the top portion 312 of the connector assembly 300) is within a threshold distance.

Figure 2C:
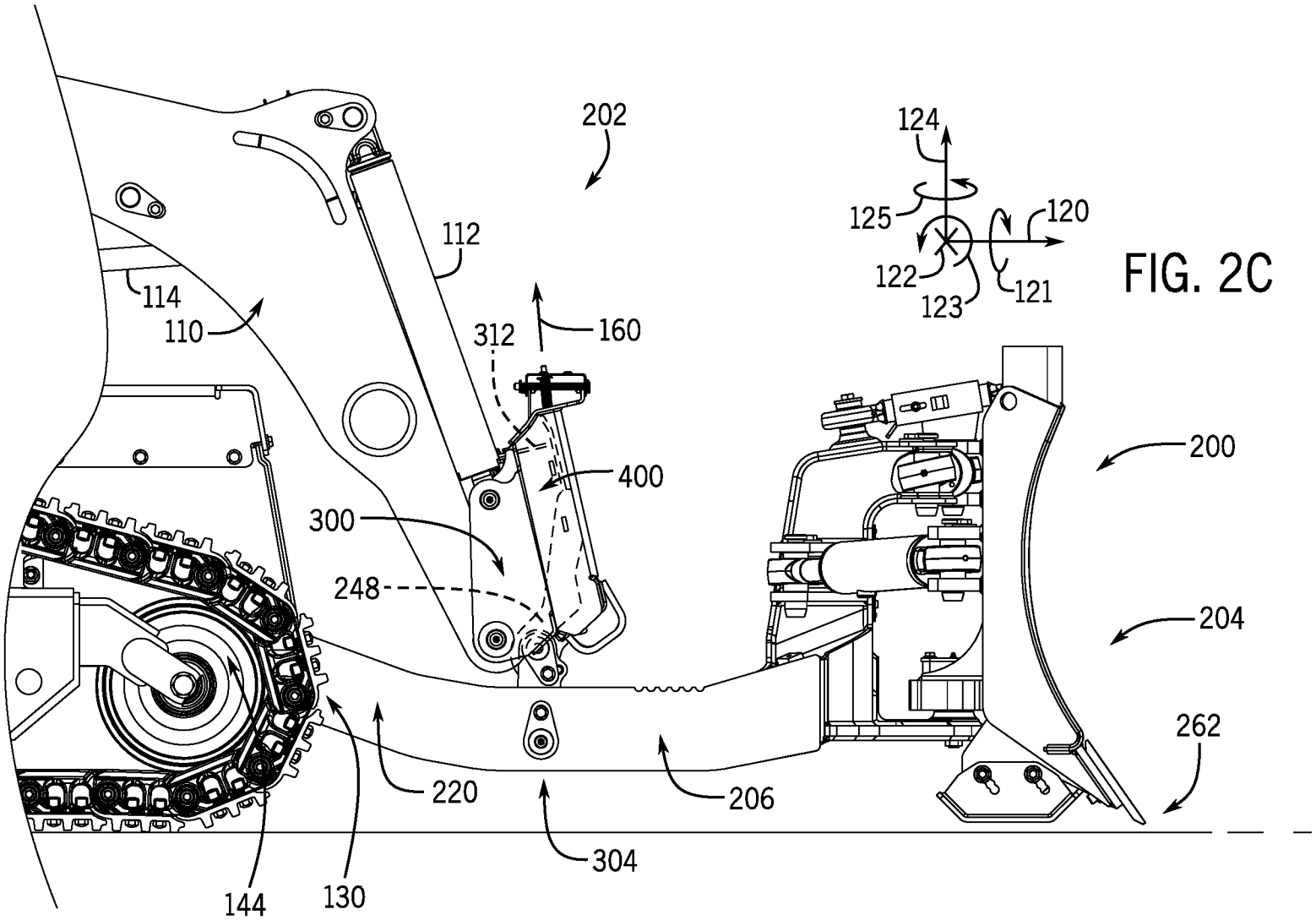
FIG. 2C is a side view of the connector assembly of FIG. 1B coupled to the implement of FIG. 1A, in which the implement is in the operating position.

FIG. 2C is a side view of the connector assembly 300 of FIG. 1B coupled to the implement 200 of FIG. 1A, in which the implement is in the operating position 202. As shown, the connector assembly 300 remains aligned and locked with the receiver assembly 400. Additionally, the operator may control a valve assembly to lock the tilt actuator 112, and then control the valve assembly to contract the lift actuator 114. The controls may be provided sequentially or simultaneously. In this manner, the arm 110 lifts to apply a lifting force 160 in the vertical direction 124. In certain embodiments, the implement 200 is heavier at the working assembly 204 than at the mounting portion 220. Accordingly, a third point of rotation 262 of the implement 200 is located near the working assembly 204 of the implement 200 (e.g. at a contact point between the working assembly 204 and a ground beneath the working assembly 204). As such, when the lifting force 160 is applied to the implement 200 via the first connection 304, the mounting portion 220 of the implement 200 rotates upwardly to align with the corresponding locking features of the work vehicle.

In certain embodiments, the operator controls the application of the lifting force 160. For example, the operator controls the lift actuator 114 to achieve a target arm upward movement distance that moves the mounting portion 220 to the target mounting portion vertical position. The operator may control the lift actuator to move the mounting portion 220 until the separation distance between the openings of the mounting portion 220 and the openings of the corresponding mounting features 144 is less than a threshold separation distance.

In certain embodiments, when the openings of the mounting portion are aligned with the openings of the corresponding locking features 144, the operator then controls the actuators to move the locking elements into the corresponding locking features 144. In this manner, the implement 200 is coupled to the work vehicle 100 to form the first connection 304 and the second connection 130. The tilt actuator 112 may be locked in position to block further tilting of the receiver assembly 400 during operation and/or the operator may disengage the parking brake.

Figure 3:
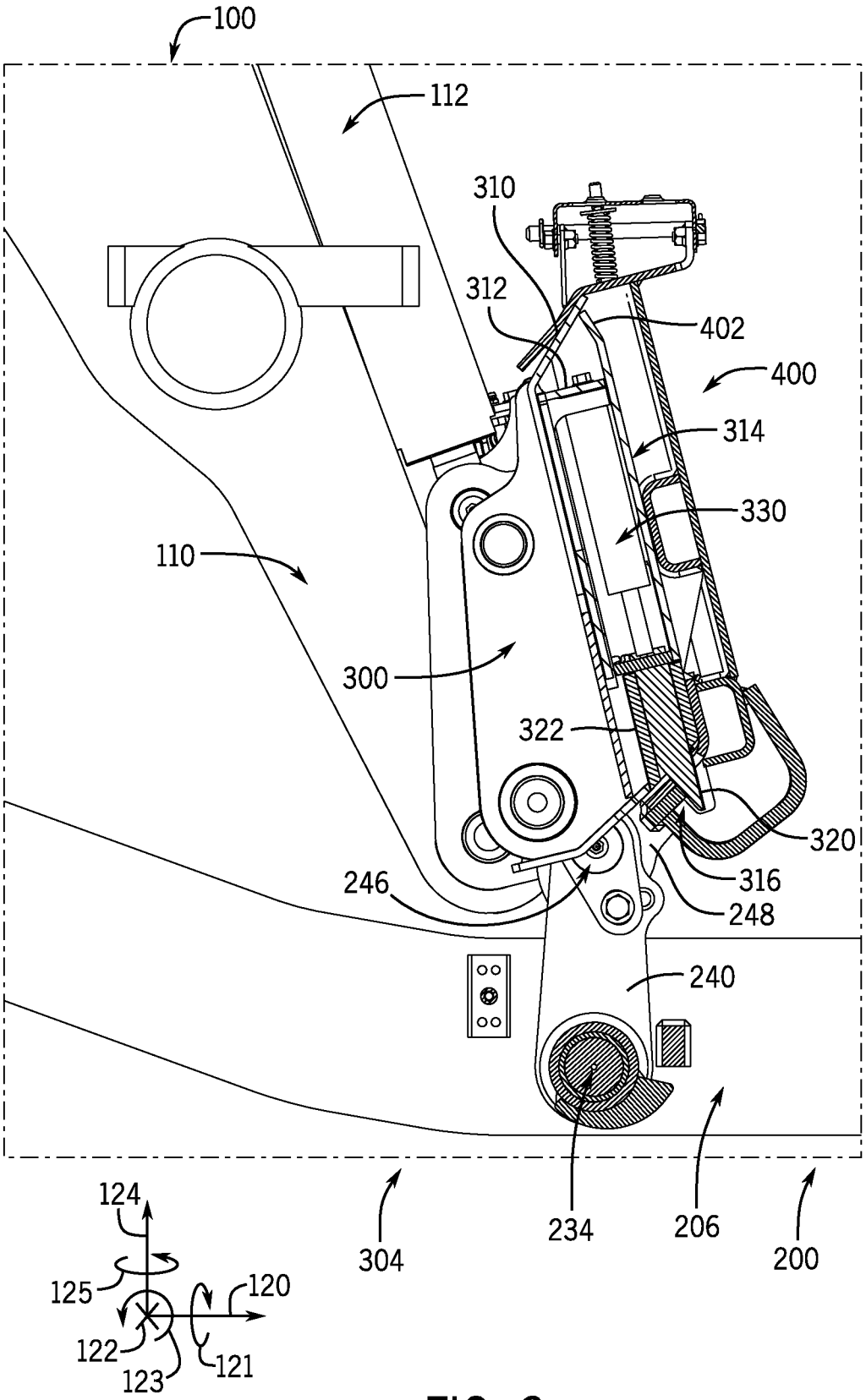
FIG. 3 is a cross-sectional view of the implement of FIG. 1A coupled to the work vehicle of FIG. 1A.

FIG. 3 is a cross-sectional view of the implement 200 of FIG. 1A coupled to the work vehicle 100 of FIG. 1A. As illustrated, the connector assembly 300 of the arm 110 is coupled to the receiver assembly 400 of the implement 200 to establish the first connection 304. The cross-section of the cross-sectional view extends in a plane along the directions 120 and 124 to show components of the connector assembly 300 and the implement 200 in detail. As shown, the protrusions 310 of the connector assembly 300 are disposed within (e.g., engage with) the recesses 402 of the receiver assembly 400. Additionally, the locking features 316 are extended to the second position to interface with (e.g., engage with) the corresponding locking features of the receiver assembly 400.

As described in further detail below, in certain embodiments, the connector assembly 300 may be coupled to the receiver assembly 400 by first engaging the protrusions 310 with the recesses 402 of the receiver assembly 400. To do so, the connector assembly 300 may approach the receiver assembly 400 while in a tilted position in which the protrusions 310 are tilted forward in pitch 123 such that the protrusions 310 are angled away from the work vehicle 100 (achieved via the tilt actuator 112). The protrusions 310 may then interface with the recesses 110 of the receiver assembly 400, and then the tilt actuator 112 tilts the connector assembly 300 to a vertical orientation. Then, the locking features 316 are driven into engagement (e.g. to the second position) to interface with the corresponding locking features 406 of the implement to physically couple the connector assembly 300 and the receiver assembly 400 to one another to establish the first connection 304.

The locking features 316 couple the connector assembly 300 to the receiver assembly 400 to establish the first connection 304. In the present embodiments, the locking features 316 are extended to the second position and the extensions 320 are in contact with the corresponding locking features 406 of the receiver assembly 400. As shown, a first locking actuator 330 is disposed inside the connector assembly 300. The first locking actuator 330 is in fluid communication with a valve assembly that provides hydraulic fluid to the actuator to extend and retract the extensions 320. In certain embodiments, the corresponding locking features 406 are openings configured to receive the locking features 316 of the connector assembly 300. Accordingly, when the locking features 316 are in the second position, the extensions 320 extend into the corresponding locking features 406 to couple the connector assembly 300 to the receiver assembly 400 of the implement 200.

The points of rotation 234, 246 enable the receiver assembly 400 to pivot in pitch 123 with respect to the pivot tube and with respect to the frame 206 of the implement 200. The points of rotation 234, 246 provide more flexibility to the implement 200, which may facilitate performing the coupling process. The implement 200 distributes a substantial portion of the horizontal forces (e.g., forces extending substantially in a plane formed by the directions 120 and 122, the horizontal component of a force vector, etc.) directly to the frame of the work vehicle 100, as compared to the arms 110. The pivot assembly 210 and the associated points of rotation 234, 246 enable all or a substantial portion of the horizontal forces to be distributed to the frame 102 of the work vehicle 100. For example, if a force with both vertical and horizontal components is applied to the implement 200, a substantial portion of the horizontal component of the force is applied to the frame 102 and a substantial portion of the vertical component is applied to the arms 110. In this manner, the implement 200 may resist larger forces and/or perform more work than implements not connected to the frame 102.

In the illustrated embodiment, the first point of rotation 234 and the connector assembly 300 are positioned such that the first point of rotation 234 and the top portion 312 of the connector assembly 300 are substantially longitudinally aligned (e.g., substantially aligned along the longitudinal axis 120). That is, the first point of rotation 234 and the top portion 312 of the connector assembly 300 are positioned such that the distance along the longitudinal direction 120 between the first point of rotation 234 and top portion 312 of the connector assembly 300 is within a threshold distance. Additionally, the first point of rotation 234 and the top part 412 of the receiver assembly 400 are substantially longitudinally aligned (e.g., substantially aligned along the longitudinal axis 120). That is, the first point of rotation 234 and the top part 412 of the receiver assembly 400 are positioned such that the distance along the longitudinal direction 120 between the first point of rotation 234 and the top part 412 of the receiver assembly 400 is within a threshold distance. For example, the threshold distance (e.g., distance between the top part of the receiver assembly and the first point of rotation, or the distance between the top portion of the connector assembly and the first point of rotation) may be 0.1 cm, 0.5 cm, 1 cm, 5 cm, or 10 cm.

In certain embodiments, "substantially longitudinally aligned" refers to a difference in position along the longitudinal axis 120 of 0.1 cm to 10 cm, 0.5 cm to 10 cm, 1 cm to 10 cm, 2 cm to 8 cm, 3 cm to 5 cm, or 4 cm to 5 cm. Furthermore, in certain embodiments, "substantially longitudinally aligned" refers to a difference in position along the longitudinal axis 120 of less than 0.1 cm, 0.5 cm, 1 cm, 5 cm, or 10 cm. In addition, in certain embodiments, "substantially longitudinally aligned" refers to a maximum difference in position along the longitudinal axis 120 expressed as a percentage of the longitudinal extent of the frame 206. For example, the maximum percentage of distance between the first point of rotation 234 and the top portion 312 of the connector assembly 300 along the longitudinal axis 120 relative to the longitudinal extent of the frame 206 of the implement 200 may be less than 1 percent, 2 percent, 3 percent, 4 percent, or 5 percent.

While only certain features have been illustrated and described herein, many modifications and changes will occur to those skilled in the art. It is, therefore, to be understood that the appended claims are intended to cover all such modifications and changes as fall within the true spirit of the disclosure.

The invention claimed is:

1. A connection system for coupling a working assembly to a work vehicle comprising:

a frame having a mounting portion at a first longitudinal end of the frame of the connection system, wherein the mounting portion is configured to couple directly to a frame of the work vehicle;

a mounting assembly for the working assembly at a second longitudinal end of the frame of the connection system; and a receiver assembly movably coupled to the frame of the connection system, wherein the receiver assembly is configured to rotate about a point of rotation positioned along the frame of the connection system longitudinally between the first longitudinal end and the second longitudinal end, the receiver assembly is configured to couple to a connector assembly on an arm of the work vehicle, a top part of the receiver assembly is configured to receive a top portion of the connector assembly, and an offset along a longitudinal axis between the top part of the receiver assembly and the point of rotation is less than 5 cm while the receiver assembly is in a receiving position.

2. The connection system of claim 1, wherein the offset along the longitudinal axis between the top part of the receiver assembly and the point of rotation is less than 1 cm while the receiver assembly is in the receiving position.

3. The connection system of claim 1, wherein the offset along the longitudinal axis between the top part of the receiver assembly and the point of rotation is less than 2 cm while the receiver assembly is in the receiving position.

4. The connection system of claim 1, wherein the offset along the longitudinal axis between the top part of the receiver assembly and the point of rotation is less than 5 percent of a longitudinal extent of the frame of the connection system while the receiver assembly is in the receiving position.

5. The connection system of claim 1, comprising a link configured to movably couple the receiver assembly to the frame of the connection system, wherein the link is positioned between the first longitudinal end of the frame of the connection system and the second longitudinal end of the frame of the connection system, a first end of the link is pivotally coupled to the frame of the connection system at the point of rotation, and a second end of the link is pivotally coupled to the receiver assembly.

6. The connection system of claim 5, comprising a pivot tube pivotally coupled to the frame of the connection system, wherein the first end of the link is rigidly coupled to the pivot tube, such that the first end of the link is pivotally coupled to the frame of the connection system via the pivot tube.

7. The connection system of claim 5, wherein the receiver assembly comprises an extension, and the second end of the link is pivotally coupled to the extension.

8. A system comprising:

a work vehicle, comprising:

a frame;

a connector assembly disposed on an arm of the work vehicle;

an implement, comprising:

a frame having a mounting portion at a first longitudinal end of the frame of the implement, wherein the mounting portion is configured to couple directly to the frame of the work vehicle;

a mounting assembly at a second longitudinal end of the frame of the implement; and a receiver assembly movably coupled to the frame of the implement, wherein the receiver assembly is configured to rotate about a point of rotation positioned along the frame of the implement longitudinally between the first longitudinal end and the second longitudinal end, the receiver assembly is configured to couple to the connector assembly to establish a first connection, a top part of the receiver assembly is configured to receive a top portion of the connector assembly to couple the receiver assembly to the connector assembly, and an offset along a longitudinal axis between the top portion of the connector assembly and the point of rotation is less than 5 cm while the connector assembly initially engages the receiver assembly and the receiver assembly is in a receiving position.

9. The system of claim 8, wherein the offset along the longitudinal axis between the top portion of the connector assembly and the point of rotation is less than 1 cm while the connector assembly initially engages the receiver assembly and the receiver assembly is in the receiving position.

10. The system of claim 8, wherein the offset along the longitudinal axis between the top portion of the connector assembly and the point of rotation is less than 2 cm while the connector assembly initially engages the receiver assembly and the receiver assembly is in the receiving position.

11. The system of claim 8, wherein the offset along the longitudinal axis between the top portion of the connector assembly and the point of rotation is less than 5 percent of a longitudinal extent of the frame of the implement while the connector assembly initially engages the receiver assembly and the receiver assembly is in the receiving position.

12. The system of claim 8, wherein the implement comprises a link configured to movably couple the receiver assembly to the frame of the implement, the link is positioned between the first longitudinal end of the frame of the implement and the second longitudinal end of the frame of the implement, a first end of the link is pivotally coupled to the frame of the implement at the point of rotation, and a second end of the link is pivotally coupled to the receiver assembly.

13. The system of claim 12, wherein the implement comprises a pivot tube pivotally coupled to the frame of the implement, and the first end of the link is rigidly coupled to the pivot tube, such that the first end of the link is pivotally coupled to the frame of the implement via the pivot tube.

14. The system of claim 12, wherein the receiver assembly comprises an extension, and the second end of the link is pivotally coupled to the extension.

15. An implement comprising:

a frame having a mounting portion at a first longitudinal end of the frame of the implement, wherein the mounting portion is configured to couple directly to a frame of a work vehicle;

a mounting assembly at a second longitudinal end of the frame of the implement; and a receiver assembly movably coupled to the frame of the implement, wherein the receiver assembly is configured to rotate about a point of rotation positioned along the frame of the implement longitudinally between the first longitudinal end and the second longitudinal end, the receiver assembly is configured to couple to a connector assembly disposed on an arm of the work vehicle, a top part of the receiver assembly is configured to receive a top portion of the connector assembly, the point of rotation is within a threshold distance along a longitudinal axis of the top part of the receiver assembly while the receiver assembly is in a receiving position, and the threshold distance is less than 5 cm.

16. The implement of claim 15, wherein the threshold distance is less than 2 cm.

17. The implement of claim 15, wherein the top portion of the connector assembly is within a second threshold distance of the point of rotation while the connector assembly initially engages the receiver assembly and the receiver assembly is in the receiving position.

18. The implement of claim 15, wherein the second threshold distance is less than 5 cm.

19. The implement of claim 15, comprising a link configured to movably couple the receiver assembly to the frame of the implement, wherein the link is positioned between the first longitudinal end of the frame of the implement and the second longitudinal end of the frame of the implement, a first end of the link is pivotally coupled to the frame of the implement at the point of rotation, and a second of the link is pivotally coupled to the receiver assembly.

20. The implement of claim 19, wherein the receiver assembly comprises an extension, and the second end of the link is pivotally coupled to the extension.

* * * * *